United States Patent [19]

Titchener et al.

[11] Patent Number: 4,828,051

[45] Date of Patent: May 9, 1989

[54] METHOD AND APPARATUS FOR DATA TRANSMISSION IN A WELL USING A FLEXIBLE LINE WITH STIFFENER

[75] Inventors: Paul F. Titchener, Menlo Park; Michael J. M. Walsh, Kentwood, both of Calif.

[73] Assignee: Comdisco Resources, Inc., San Francisco, Calif.

[21] Appl. No.: 109,306

[22] PCT Filed: Feb. 7, 1986

[86] PCT No.: PCT/US86/00263

§ 371 Date: Oct. 7, 1987

§ 102(e) Date: Oct. 7, 1987

[87] PCT Pub. No.: WO87/04755

PCT Pub. Date: Aug. 13, 1987

[51] Int. Cl.[4] ..... E21B 49/00; G01V 3/18; G01V 1/40

[52] U.S. Cl. ..... 175/50; 166/250; 324/323; 340/855

[58] Field of Search ..... 166/65.1, 250; 175/50; 33/312; 73/151; 340/854, 855; 324/323, 356, 369

[56] References Cited

U.S. PATENT DOCUMENTS

| | | | |
|---|---|---|---|
| Re. 21,102 | 5/1939 | Jakosky | 175/182 |
| 2,172,625 | 9/1939 | Schlumberger | 175/182 |
| 2,242,612 | 5/1941 | Leonardon | 73/51 |
| 2,350,832 | 6/1944 | Segesman | 177/311 |
| 2,826,736 | 3/1958 | Doll | 324/2 |
| 3,149,490 | 9/1964 | Clements et al. | 324/356 X |
| 3,434,046 | 12/1965 | Wilson et al. | 324/34 |
| 3,573,349 | 4/1971 | Bowers | 174/108 |
| 4,035,763 | 7/1977 | Cowles | 340/18 |
| 4,057,781 | 11/1977 | Scherbatskoy | 340/18 LD |
| 4,220,381 | 9/1980 | Van der Graat | 339/16 C |
| 4,236,113 | 11/1980 | Wiley | 324/366 |
| 4,286,217 | 8/1981 | Planche et al. | 324/347 |
| 4,349,072 | 9/1982 | Escaron | 166/250 |
| 4,468,665 | 8/1984 | Thawley et al. | 340/856 |
| 4,523,148 | 6/1985 | Maciejewski | 324/323 X |
| 4,684,946 | 8/1987 | Issermann | 340/855 |

FOREIGN PATENT DOCUMENTS

| | | |
|---|---|---|
| 03382 | 11/1981 | European Pat. Off. . |
| 0122839 | 10/1984 | European Pat. Off. . |
| 1557863 | 12/1979 | United Kingdom . |

*Primary Examiner*—William P. Neuder
*Attorney, Agent, or Firm*—Christie, Parker & Hale

[57] ABSTRACT

A method and means is provided for receiving and passing data up hole to the top (22) of a well bore (20*a*) while passing fracturing fluid (54,60) down hole to a geological formation (44) at a zone (29) in the well bore. A flexible line (36) has suspended thereform, a receiver (34) for receiving data signals from a separate sensor (30) and transmitter (28), and a stiffener (32). The stiffener is positioned up the well bore from a lower extremity (29*b*) of the receiver. The flexible line is adapted for passing data signals representing a parameter represented by the received data signals up to the top (22) of the well bore.

27 Claims, 11 Drawing Sheets

20
38
PROCESSING
DISPLAY/STORAGE
22
58
56
54
63
42
46
24
25
52
60
20a
36
29a
48
44
32
29
29b
34
28
34a
31
30

40
20
38
PROCESSING
DISPLAY/STORAGE
22
58
56
54
63
26a
42
46
24
21
60
52
26
36
29a
48
44
32
24
29b
28
34
31
30

100
114
104
108
116
106
109
111
120
112
118
122
123
110
202
202
32
170
171
174
210
172
176
178
182
184
180
210

METHOD AND APPARATUS FOR DATA TRANSMISSION IN A WELL USING A FLEXIBLE LINE WITH STIFFENER

CROSS REFERENCES

The patent applications whose titles, serial numbers and filing dates are noted below have the same inventors as the present patent application and disclose subject matter which is common to the present patent application:

Telemetry System Using an Antenna, U.S. Ser. No. 700,352; filed Feb. 11, 1985; and Method and Means for Obtaining Data Representing a Parameter of Fluid Flowing Through a Down Hole Side of an Oil or U.S. Ser. No. 918,252; and Method and Apparatus for Data Transmission in a Well Bore Containing a Conductive Fluid, U.S. Ser. No. 934,610 both filed on even date herewith and claiming priority of said U.S. Ser. No. 700,352.

FIELD OF THE INVENTION

This invention relates to methods and apparatus for communicating data from the bottom to the top of a well.

BACKGROUND OF THE INVENTION

Oil and gas wells are known having a well bore for passing fluid, transversely across a side of the well bore at a down hole location of the well bore and longitudinally in the well bore, between a geological formation located at the down hole location and a top portion of the well bore. The pressure of the fluid flowing across the side of the well is an important parameter to know by operators at the top of the well. Other parameters of the fluid as it flows across the side of the well may also be important to know at the top of the well. For example, during fracturing, when fluid is passed into the geological formation, pressure at the down hole location is important in determining whether a fracture is vertical or horizontal and to determine growth parameters of the fracture. Fluid pressure and temperature at the down hole location of a producing well, where fluid is flowing from the geological formation to the top of the well, may also be important in some situations. However, remoteness of the down hole location from the top of the well, high flow rates of the fracture fluid across the side of the well and the harsh environment down hole create difficulties in reliably recovering data representing the pressure and other parameters from the fluid at the down hole location..

Therefore, a need exists for easy to use apparatus and methods for recovery, at the top of a well bore, data which accurately and reliably represents a parameter, particularly pressure, of a fluid and particularly a fracture fluid, as that parameter exists in the fluid flowing through the side of the well at the down hole location.

SUMMARY OF THE INVENTION

Briefly, method and apparatus is disclosed herein for recovery of data in an oil or gas well having a well bore for passing fluid, transversely across a side of the well bore at a down hole location of the well bore and longitudinally in the well bore, to a geological formation located at the down hole location from a top portion of the well bore.

An embodiment of the present invention is a method for recovering data up hole at the top of a well bore while passing fracturing fluid down hole to a geological formation through a zone, having up hole and down hole extremities, in the well bore. Briefly the steps are as follows:

A parameter sensor and a transmitter of data signals are positioned at a location in the well bore which is substantially down hole from the zones down hole extremity. The data signals represent a parameter sensed by the sensor. A flexible line, preferably a wire line is lowered in the well that has, suspended therefrom, a receiver which is separate from the sensor and transmitter and a stiffener positioned up hole from the down hole extremity of the receiver with at least one insulated conductor passed up to the top of the well bore through the stiffener and the line. The step of lowering also includes the step of lowering the line until the receiver is in proximity to the transmitter and at least a portion of the stiffener extends substantially from the up hole extremity to the down hole extremity in front of the zone.

Preferably, the step of lowering includes the step of attaching to a lower end of the line, as the stiffener, a substantially rigid cylindrical member and then lowering the line and the cylindrical member and the receiver. By using a plurality of the cylindrical members attached end to end, the stiffener can be made large enough to span very large or lengthy zones through which the fracturing fluid flows. The receiver is, preferably, attached to a free lower end of one of the cylindrical members. In one arrangement the receiver senses potentials applied in the fracturing fluid. In another arrangement the receiver senses magnetic signals.

Preferably, the parameter represented by the data signals is pressure.

One embodiment has the sensor and transmitter mounted together in a single module and the module is dropped down the inside of tubing string or down the casing due to the pull of gravity or assisted with fluid pressure.

A number of advantages can be achieved by the present invention. By way of example, the flexible line can be lowered so that the receiver is down immediately adjacent to or near by the transmitter, and as a result, the distance over which signals must be transmitted is minimized. Thus, where the transmitter and receiver are at the bottom of the well bore below the zone through which the fracturing fluid is passed, the stiffeners provide a substantially rigid member in front of the zone preventing the insulated conductor from being sucked into or whipped into the openings formed in the zone.

It is possible to position the receiver after the casing is set. It is unnecessary to preattach the receiver to casing or the like.

Additionally, where the casing has become weak because of deterioration or because of the depth of the well bore, it is possible to run tubing down the center of the casing, lower the flexible line, receiver and stiffener in the annulus between the tubing and casing and pass the fracturing fluid down the tubing. As a result the flow of the fluid is not in direct contact with the flexible line until it gets close to the zone through which the fracturing fluid is passed thereby minimizing the downward pull and wear on the flexible line.

With arrangements where there is a tubing string inside of a casing, it is desirable to make the tubing string as large in diameter as possible, relative to the inside of the casing causing the annulus spacing to be quite small, leaving very little room for passing parts on a flexible line or otherwise down the well. Since a receiver can be made quite small, by mounting only the receiver and stiffener on the line it is possible to pass or feed the line down the annulus. Minimizing the obstruction to the line in the annulus by minimizing the parts hung on the line as it is passed down the annulus is, therefore, very important. The parts which are larger in a transverse direction, such as the transmitter, sensor and the battery for the transmitter and receiver, are separated from the receiver and line and are lowered to the desired position. This can be done either by mounting them on a tubing string and lowered, or they can be dropped (i.e., "air mailed") down the hole in a common module. If the transmitter, sensor and battery are air mailed, this can be done down the inside of the tubing string or down the casing prior to insertion of the tubing.

DETAILED DESCRIPTION OF THE PREFERRED EMBODIMENTS

Figure 1:
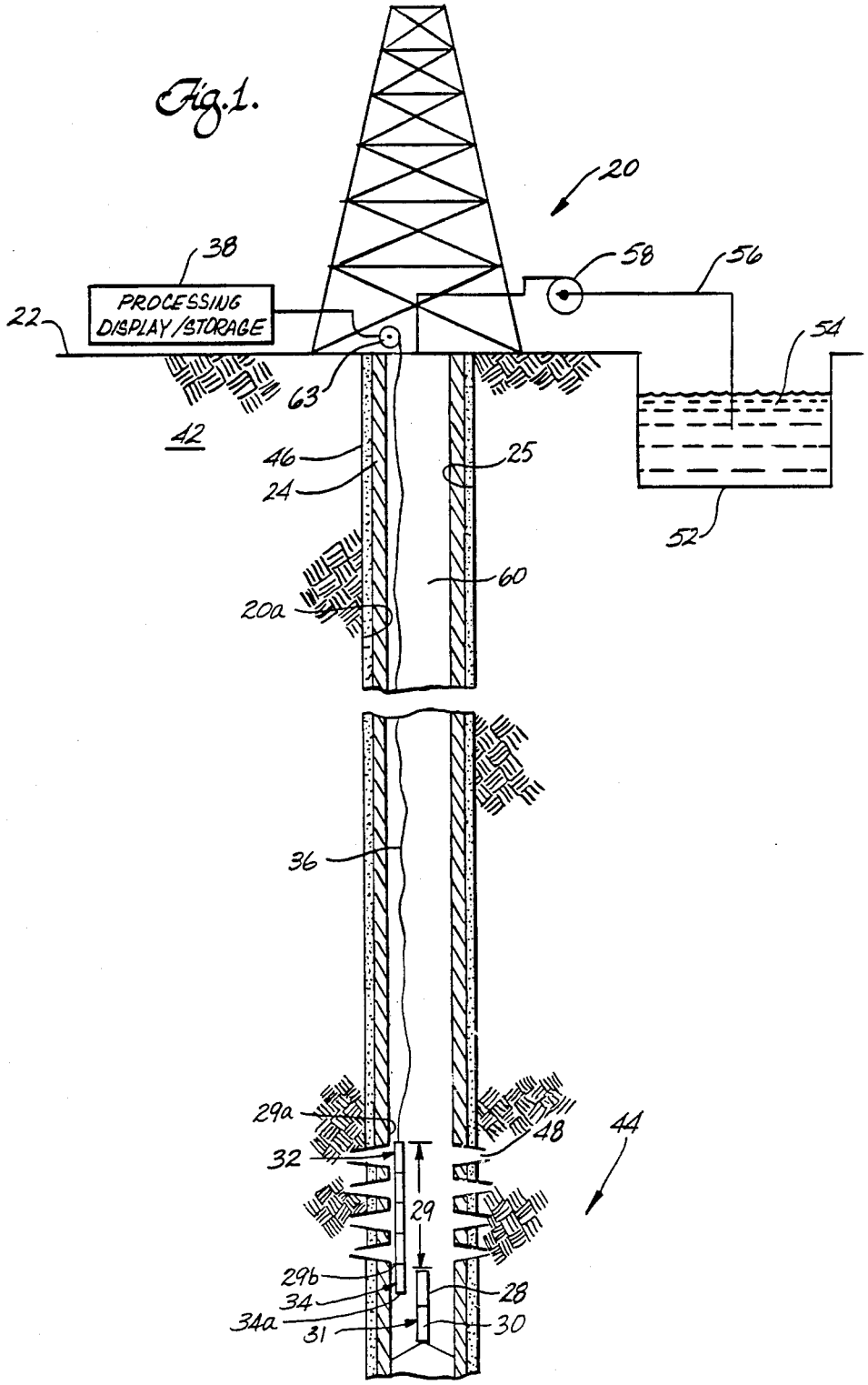
FIG. 1 is a schematic of an oil or gas well showing tubular casing and cement in cross-section within a well bore to reveal a receiver and a stiffener suspended from a wire line which extends to the top of the well bore and a sensor and transmitter and embodies the present invention.

FIG. 1 is a schematic and partial cross-sectional view of an oil or gas well 20 and illustrates a method and means for obtaining from down hole, data signals which represent a parameter, preferably pressure, in a well bore 25.

The well has a tubular casing 24 cemented by means of cement 46 into on the inside of well bore 20*a*. A transmitter 28 and a sensor 30 contained in a module 31 are located at the bottom of the well bore or on a plug in the well located below one or more perforations 48 through which fracture fluid 60 is passed to an adjacent formation 44.

The perforations 48 are, by way of example, holes or a cutout through the casing made, as well known in the well drilling art, which extend throughout a zone in the well bore indicated at 29 having as a zone upper extremity 29*a* and a zone lower extremity 29*b*.

A flexible wire line has, suspended therefrom, a receiver which is separated from the sensor and transmitter. The wire line also has a stiffener 32 which is positioned up hole from the down hole extremity 34*a* of a receiver 34. An insulated conductor, shown and disclosed in more detail with reference to FIG. 3 passes up to the top of the well bore through the stiffener and the wire line. The stiffener extends completely across the zone 29 in front of the perforations 48. As a result, the receiver 34 can be placed down adjacent to or very close to the transmitter below the fracture zone without having the flexible wire line, or the insulated conductor, exposed in front of the zone 29 where fast flowing fracture fluid passing through the perforations 48 would tend to draw them into the perforations and damage or destroy these flexible elements.

Although stiffener 32 is shown as a separate element from the receiver 34, it should be understood that the stiffener may actually encompass a portion of the receiver.

The well extends into the earth 42 to a geologic stratum or formation 44 from which oil or other hydrocarbons are to be produced. The invention is especially well suited for wells that may extend anywhere from 5,000 to 20,000 feet or more below the surface. Though the apparatus and method, according to the present invention can be used in shallower wells, it is especially well suited for deeper wells.

A basin or tank 52 holds the fracturing fluid 54. Fluid 54, under the pressure developed in pump 58, is supplied through a supply line 56, through the central passage of casing 24 and through the perforations 48 to the formation.

The fracturing fluid is applied under pressure at a high flow rate to the formation for creating, opening up or enlarging a fracture on the formation.

In operation, the sensor 30 and transmitter 28 are located in the well bore at the bottom at a position which is adjacent to or substantially down hole from the zone 29 up hole extremity 29*a*. The sensor is preferably for sensing bottom hole pressure and the transmitter provides data signals to the receiver which represent the pressure parameter sensed by the sensor.

A flexible wire line is lowered in the well bore while having suspended therefrom the receiver, which is separate from the sensor and transmitter. Additionally, the wire line has suspended therefrom the stiffener which is positioned up hole from the down hole extremity of the receiver. An insulated conductor (to be described) passes up to the top of the well bore through the stiffener and the wire line. The wire line is lowered until the receiver is in proximity to the transmitter and the stiffener extends substantially from the zone up hole extremity to the zone down hole extremity in front of the zone as depicted in FIG. 1. Preferably the stiffener extends completely across the zone 29 slightly beyond the up hole and down hole extremities. The stiffener is more rigid than the wire line and is sufficiently rigid that it is not drawn into the perforations.

The pump is then started causing the fracturing fluid to start flowing down through the central passage of the casing 24 past the stiffener 32 through the perforations of the zone 29 into the adjacent formation for fracturing as discussed above.

Electronics in the sensor in the transmitter, and, to the extent present, in the receiver are active during the process of fracturing. For example, a start timer may be included in the transmitter which times out and activates the electronics. Alternatively, the electronics operations may be initiated before the tubing and packer are lowered in place.

As the fracturing fluid is forced through the perforations 48 and into the surrounding region the flow is impeded by the earth formation so that pressure is developed in the area of the perforations. The pressure is sensed by sensor 30 which produces signals for transmitter 28 which are a function of the pressure. The signals are manipulated or processed as desired and data signals representing the pressure are passed by transmitter 28 to and are received by the receiver 34. Data signals representing the pressure are then conducted along wire line 36 to the processing display and storage apparatus 38 for analysis, and display and/or storage.

The wire line is wound on a reel 63 at the top of the well. The receiver is made up on the end of the wire line and then the reel is rotated to unwind the wire line and lower the receiver and stiffener down the well bore or disconnected above. Preferably the lowering of the receiver is done after the transmitter is lowered into place.

Figure 2:
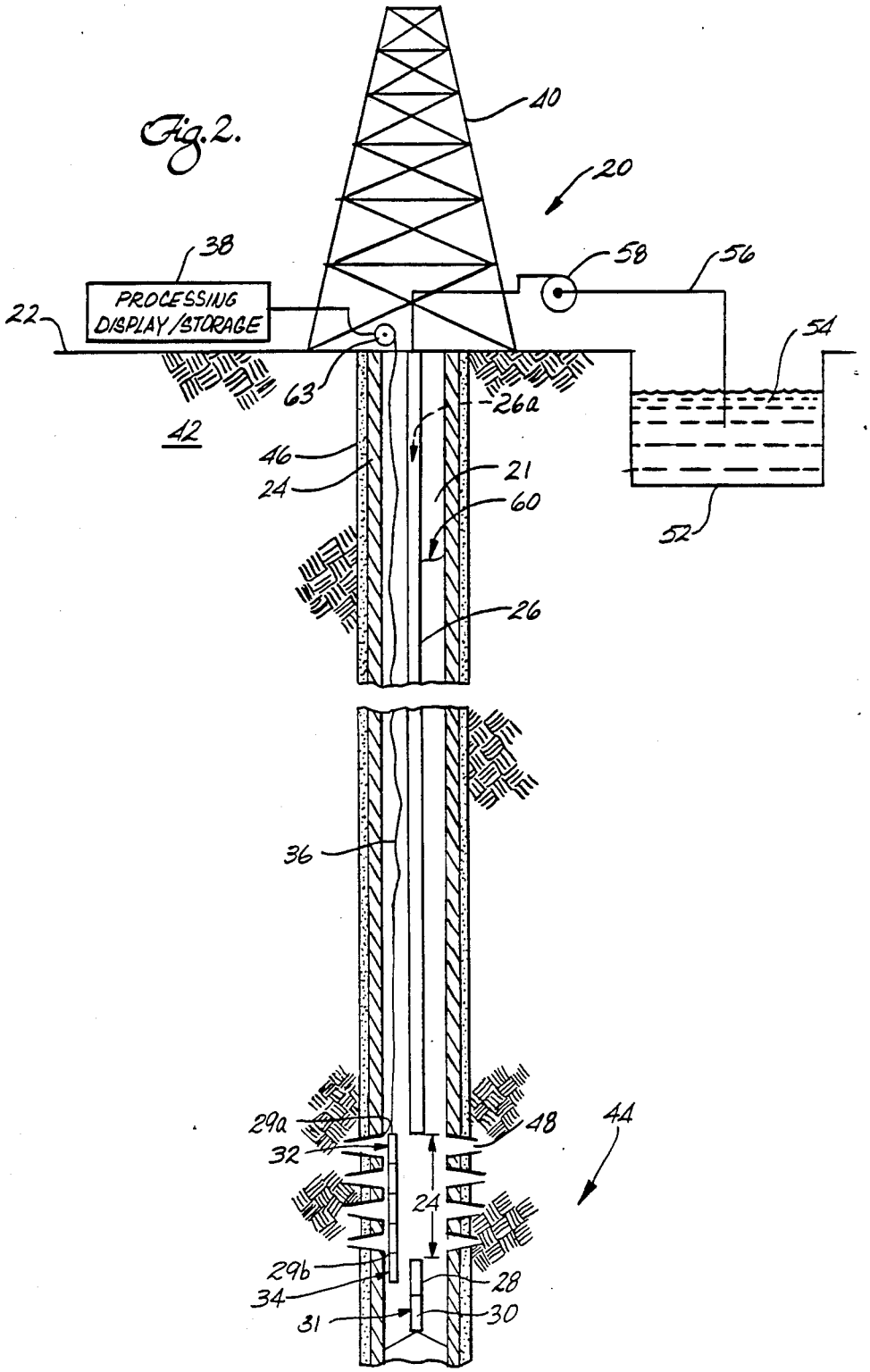
FIG. 2 is a schematic and partial cross-sectional view similar to FIG. 1 with tubing creating an annulus for the wire line down to the fracture zone and embodies the present invention.

FIG. 2 is a schematic and cross-sectional view essentially the same as FIG. 1 except that tubing 26 is shown for passing the fracturing fluid down the well bore to a position adjacent to or slightly above the upper extremity 29*a* of the zone 29. With this arrangement it will be necessary to plug or cap the top of the annulus between the tubing and casing to prevent the fluid from passing along the outside of the tubing and out of the top of the well as is conventional in the well drilling art. The use of the tubing has two desirable effects. First, the flowing fracture fluid is not in contact with the wire line 36 until close to the down hole location of the zone and, therefore, very little downward drag is applied to the wire line. Also, the use of the tubing protects casing that has deteriorated or become weak from the flowing fracture fluid.

The wire line includes a central insulated conductor which extends to the top of the well bore. The data signals representing the pressure parameter transmitted by transmitter 28 are received by receiver 34 and data signals representing the parameter are conducted up to the top of the well bore over the insulated conductor contained in the wire line. The wire line may be constructed in a number of different ways, but must be of suitable strength to support the receiver and stiffener and withstand the harsh environment in the well bore, and must be long enough to position the receiver as close as possible to the transmitter.

The wire line may be an insulated coaxial cable. However, preferably the wire line is similar to that conventionally used in the oil tool art, and has a central insulated conductor, insulation surrounding the central conductor and an outer metal sheath which protects the wire line from the abrasive effects of the fluid and other materials in the well with which it comes in contact when in or moving down the annulus of the well. The wire line, including the central conductor, the insulation and outer sheath extend to the top of the well, and are wound on the reel 63. Preferably the conductor is stranded.

It is typical in the well drilling art to make up the tubing string out of a number of separate pipes or annular members threaded end to end. The tubular string is lowered into the well by adding pipes one at a time to the uppermost end of the tubing string, lowering the tubing string with the connected packer into the well.

It will be understood by those skilled in this art that procedures need to be followed to prevent the inlet to the sensor from plugging up with particles from the fluid. This may be accomplished by making the sensor opening large enough that the particles do not wedge in the opening or by positioning the pressure sensing surface flush with the opening to the sensor. Preferably the outer diameter of the jacket on the wire line and the electrode are each substantially ½ inch. An optimum and preferred length for the electrode is between 3 and 10 feet. The longer the electrode the better the contact between the conductive fluid and the electrode and hence the higher the signal to noise ratio of the received signal at the top of the well. However, the shorter the electrode the easier it will be to lower the electrode on the end of the wire down to the desired position in a narrow annulus.

Figure 3:
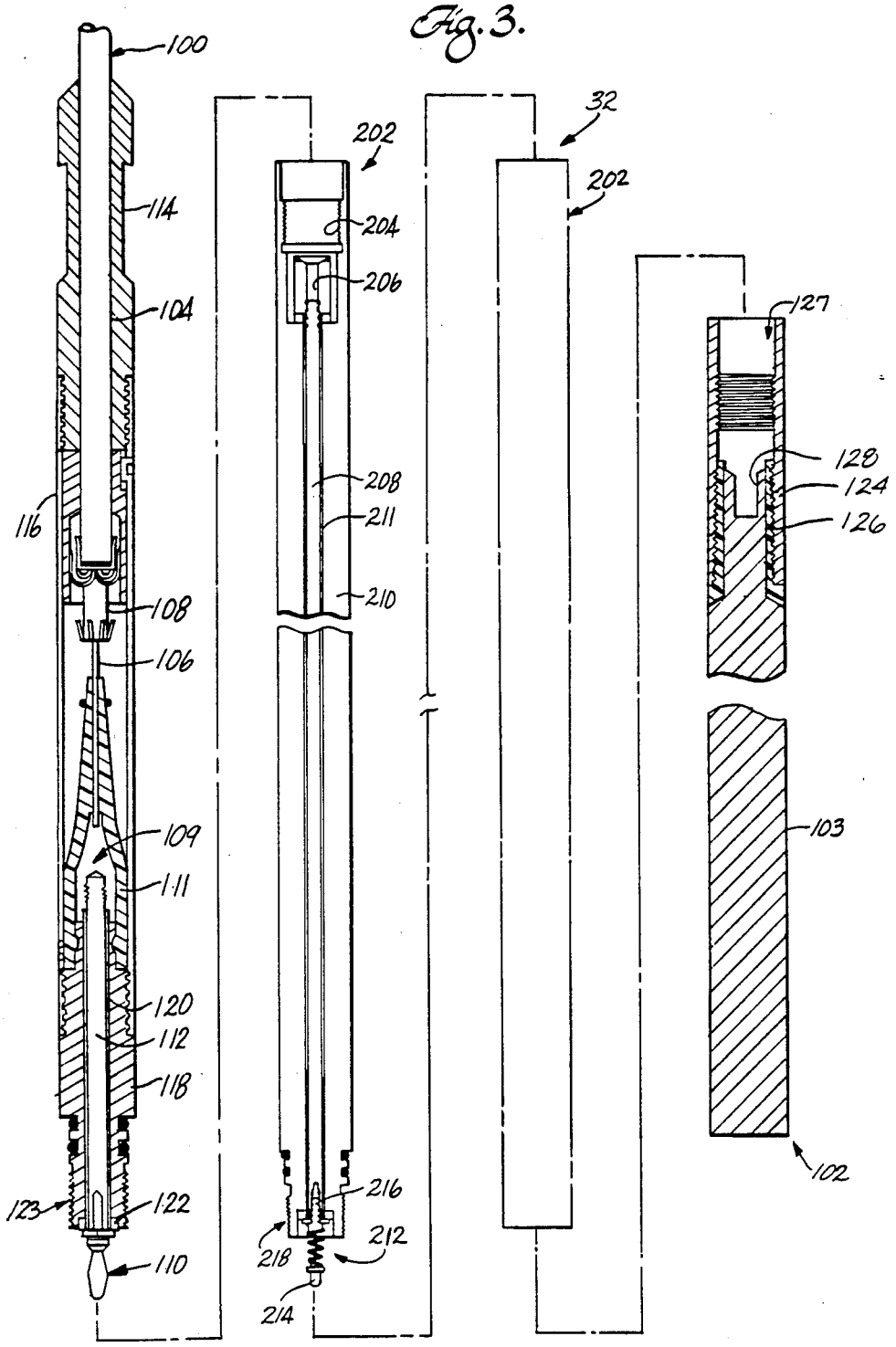
FIG. 3 is a schematic, cross-sectional and exploded view of a wire line, a stiffener, a cable head for making the stiffener up to the wire line and an exposed electrode-type receiver for receiving the data signals from the transmitter.

FIG. 3 is a cross-sectional view of a receiver made up on a wire line where the receiver is of the type for receiving potentials from the conductive fluid in the annulus. A wire line 100 has an electrode type receiver 102 suspended from the end of the wire line. The receiver 102 shown is for use with a conductive fracturing fluid 60, and is adapted for receiving electrical potentials or data signals, representing the sensed parameter, which are created in the conductive fluid.

The receiver is comprised of an electrically conductive, elongated and cylindrical shaped metallic conductor or electrode 103. The electrode is preferably copper plated steel and is exposed so that it will be in electrical contact with the surrounding conductive fluid. The electrode is suspended from the down hole end of the stiffener.

The wire line has an outer sheath 104, a central insulated conductor 106 and an annular insulator 108 separating the conductor 106 from the conductive sheath 104. The conductor 106 is connected to a spring contact or banana plug 110 by means of a terminal nut 109 having a circular bore into which the exposed end of the conductor 106 is inserted and crimped. The opposite end of the terminal nut 109 has a bore into which an end of contact rod 112 is threaded. The opposite end of the rod 112 has a threaded bore into which the rear end of banana plug 110 is threaded. The nut and electrically connected rod and plug, all being electrically conductive materials, provide continuous electrical path between the insulated conductor 106 and the plug 110. The conductive outer sheath 104 of the wire line is electrically connected in a babbit-type stinger 114 which in turn is threaded into one end of an electrically conductive sleeve 116. The opposite end of the sleeve 116 is threaded over the end of an electrically conductive contact sub 118, which in turn is electrically isolated from the rod 112 by an insulating sleeve 120 from plug 110 by an insulating washer 122.

Electrode 102 has its upper externally threaded end which is threaded into a sleeve-shaped coupler 124. An insulating sleeve 126 on the electrode 102 electrically insulates the electrode 102 from the coupler 124. The upper end of the electrode 102 contains a bore 128 into which an electrical plug of the stiffener is inserted.

The stiffener 32 is depicted in FIG. 3 as a series of cylindrical shaped stiffeners each identified by the number 202. Each stiffener is identical and all are connected end to end between the end 123 of the cable head and the up hole end of the electrode 102. Two stiffeners 202 are shown for illustration but more can be employed as required.

Each stiffener 202 includes an upper threaded connector or receptacle 204. The upper most stiffener 202 is threaded on end 123 of the cable head. An electrical receptacle or connector 206 receives the plug 110 of the cable head forming an electrical connection to a rod or conductor 208 which in turn is connected by means of a threaded connector 216 to a spring contact 214 at the lower end of the stiffener. The stiffener 202 has a rigid tubular shaped outer sleeve 210 which provides a rigid support for the conductor 208 preventing it from being drawn into the perforations during fracturing. An insulator sleeve 211 separates the conductor 208 from the outer sleeve 210. The down hole end of each stiffener 202 includes a threaded plug 218 which is either threaded into the threaded receptacle 204 of the next lower stiffener or receptacle 127 in the coupler 124 for the electrode 102. The insulating sleeve 126 insulates the coupler 124 and, therefore, the outer sleeve 210 of the stiffeners, the outer sleeve of the cable head and, therefore, the outer sheath 104 of the cable from the electrode 102.

With this arrangement, a rigid structure is formed actually starting with the upper end of the electrode 102 extending along the series of stiffeners which can be positioned in front of the zone 29 without being drawn into the perforations during the high flow rates of the fluid during fracturing.

Figure 4:
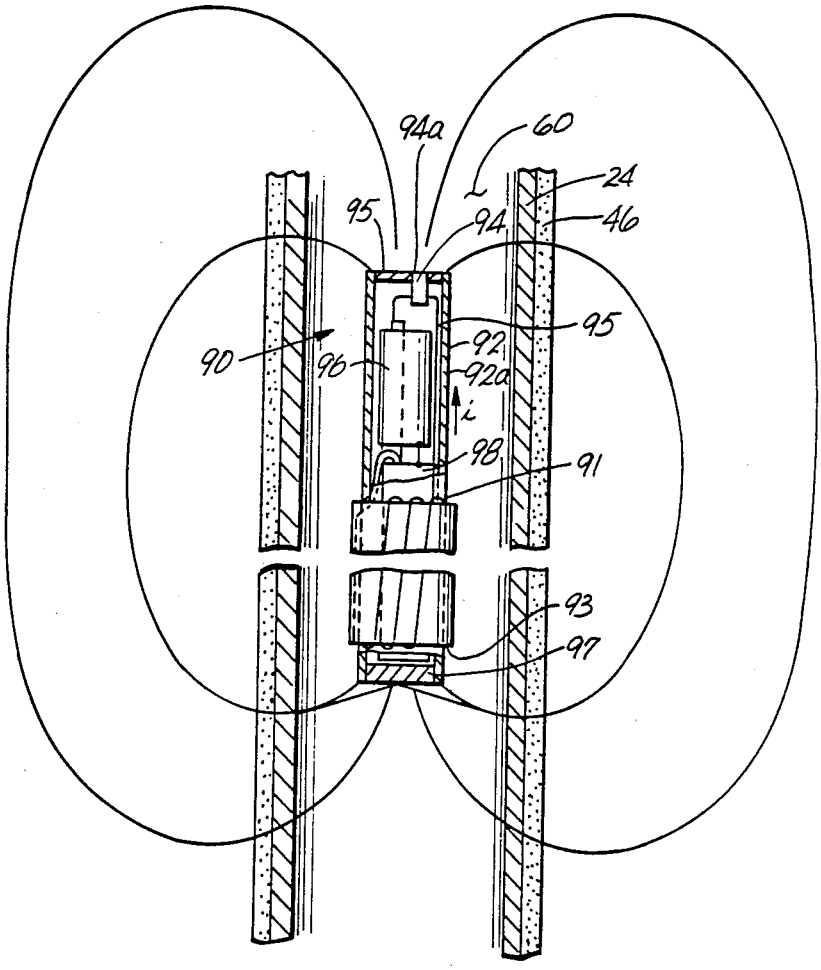
FIG. 4 is a schematic and block diagram in cross section of a sensor and transmitter mounted in a common module inside of casing.

FIG. 4 depicts the arrangement of FIGS. 1 and 2 where the sensor and transmitter are dropped or "air mailed" down the central passage of the casing or tubing string and to the bottom of the well bore. FIG. 4 depicts in cross section the casing 24, cement 46, and conductive fluid 60. The transmitter is generally depicted at 90 and is in a single modular construction together with the sensor. More specifically, the module includes an elongated, preferably about 2 foot long, segment of tubing 92 containing therein pressure sensor 94, battery 96, voltage to frequency convertor 98 and an elongated coil 91. Preferably coil 91 is mounted on a tubular shaped ferrite core 93 and together are mounted on the outside of and coaxial with tubing 92. The windings of the coil 91 are wound longitudinally along the tubular core 93 and set up a longitudinally extending flow of current in tubing 92 as depicted at "i". The current induced in the tubing 92 flows longitudinally along the wall **92*a* of the tubing 92 into surrounding conductive fracturing fluid 60 to the receiver 34 causing a potential to be induced on the electrode of receiver 34** relative to a reference.

Plugs 95 and 97, preferably made of electrically conductive material, are inserted in the opposite ends of the tubing 92 for sealing the inside of the tubing (and hence the sensor, the battery and the electronics) from the surrounding fluid. The sensor 94 has a passage **94*a* tapped through the plug 95 for sensing pressure external to the module. The coil 91 is insulated from the core and from the tubing 92 by insulation (not shown). Because of the alternating current frequency generated by the coil 91 circulating eddy currents may be set up in the tubing 92** as well as the longitudinal currents. However, the frequency of the signal is preferably sufficiently low that the eddy currents can be made small.

In some applications it will be desirable to insulate the length of the tubing 92 while using electrically conductive plugs exposed in the ends of the tube, thereby causing the longitudinally extending induced currents to flow out of the plugs into the conductive fluid. This would minimize linkage current from the sides of the tubing 92.

Figure 6:
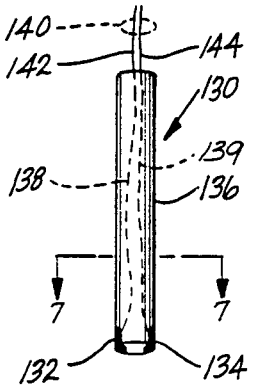
FIG. 6 is a schematic diagram of a dipole type exposed electrode receiver having two horizontally displaced electrodes for use in FIGS. 1 and 2.
Figure 7:
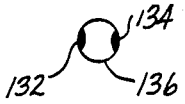
FIG. 7 is a cross-sectional view of the receiver of FIG. 6 taken along the lines 7—7.

FIGS. 6 and 7 depict an alternate horizontal dipole type receiver for receiving potentials which has a pair of horizontally displaced exposed electrodes 132 and 134 connected by leads 138 and 139 to insulated conductors 142 and 144, respectfully on or in a wire line 140. The insulated conductors 142 and 144 and the wire line 140 extend to the top of the well. If a shielded wire line is used as in FIG. 3 one of conductors 142 and 144 may be connected to the shield and the other to the central conductor. The exposed electrodes 132 and 134 are recessed into or otherwise mounted on the bottom and partially up the side of a cylindrical rod 136 made of an insulating material. The signal created in the conductive fluid causes a potential difference between the horizontally spaced electrodes 132 and 134, which can be sensed at the top of the well between the conductors 142 and 144.

Figure 8:
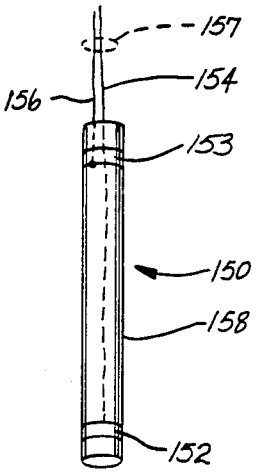
FIG. 8 is a schematic diagram of a vertical dipole exposed electrode receiver.

FIG. 8 depicts an alternate verticle dipole type receiver 150 which has vertically displaced electrodes 152 and 153 electrically connected, respectfully, to insulated conductors 154 and 156 in a wire line indicated at 157 which in turn extends to the top of the well similar to wire line 140 of FIG. 7. Electrodes 152 and 153 are ring shaped, recessed and mounted coaxially with and around the periphery of cylindrical rod 158, which is made of an insulating material.

Figure 9:
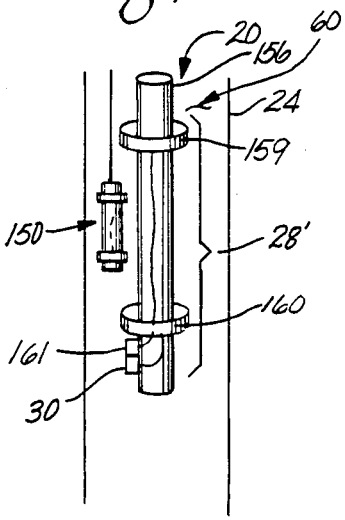
FIG. 9 is a schematic and block diagram of a well bore containing a sensor and transmitter mounted on a tube and a vertical dipole receiver.

The vertically displaced electrodes 152 and 153 and the horizontally displaced electrodes 132 and 134 of FIG. 7 are spaced sufficiently far apart to receive a potential difference on the spaced electrodes of a sufficient magnitude to be detected. The electrodes in both FIGS. 7 and 9 are recessed to protect the electrodes from physical contact with the tubing casing, fluids or other material as the receiver is passed down through the annulus and also to prevent a direct short between the electrodes due to the intervening conductive fluid. The larger the spacing between the electrodes the larger the signal will become between the electrodes.

FIG. 9 depicts a vertical dipole electrode 150 similar to that depicted in FIG. 8 adjacent a transmitter 28' and sensor 30. The transmitter 28' has spaced apart electrodes 159 and 160 mounted on an insulated cylinder 156. Electronic unit 161 applies electrical potentials between electrodes 159 and 160 representative of the bottom hole pressure sensed by pressure sensor 30.

Figure 5:
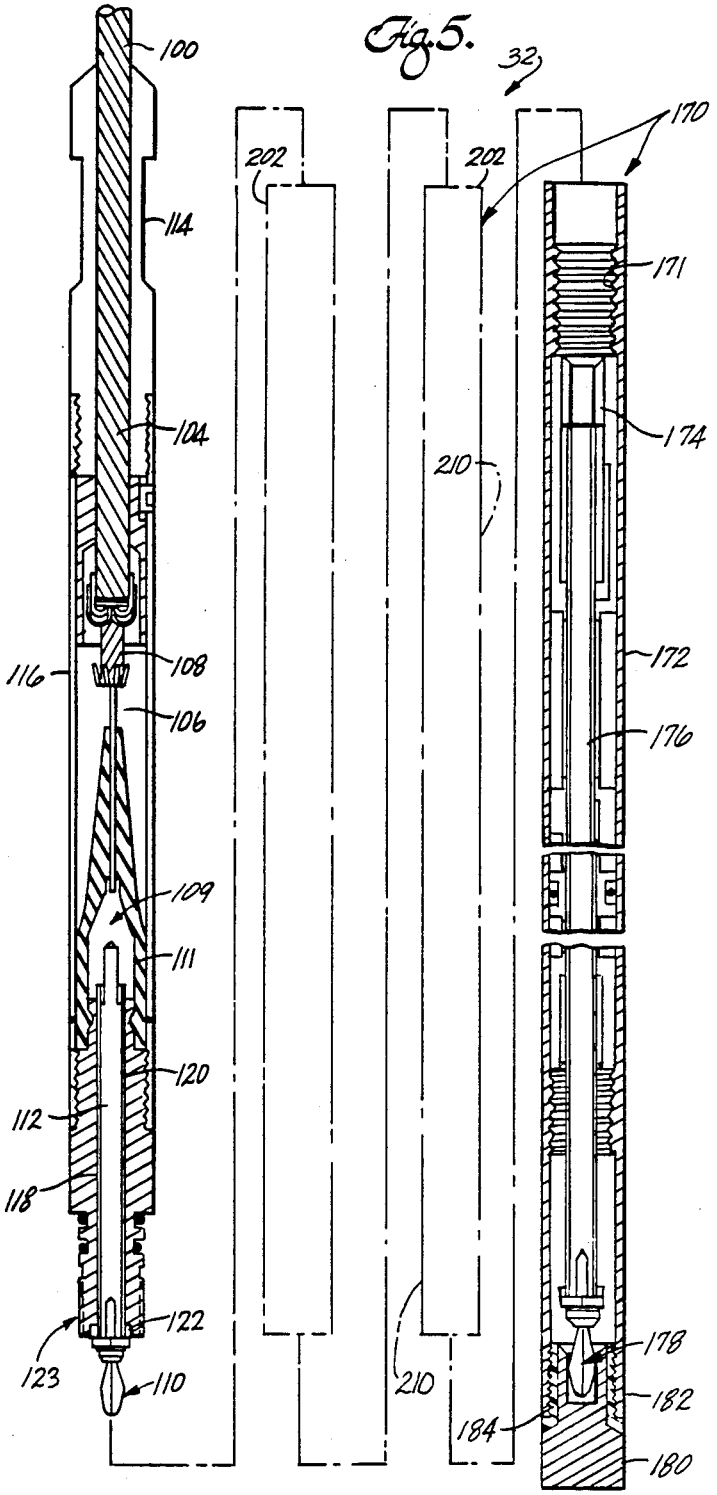
FIG. 5 is a cross-sectional view of a wire line, a cable head, a stiffener and dipole type exposed electrode receiver (having two vertically displaced electrodes) for use in FIGS. 1 and 2.

FIG. 5 shows a vertical dipole receiver in combination with the wire line 100, the cable head, and a stiffener 32 composed of stiffeners 202, all, except for the dipole receiver, being the same as described with reference to FIG. 3. The dipole receiver forms part of the stiffener and is depicted at 170 and includes a tubular member 172 whose upper end is threaded onto the lower end of the lower stiffener 202. A top receptacle 174 receives and forms an electrical contact with the contact 214 (see FIG. 3) of the adjacent stiffener 202. A contact rod 176 electrically connects the receptacle 174 to the threaded rear end of a spring contact or banana plug 178, in a similar manner to the connection of plug 110 to rod 112. The upper electrode of the dipole is formed by the electrically conductive outer surface of the sleeve 210 (see FIG. 3) on the stiffener 202 which is adjacent and above the member 172. The lower electrode is formed by an electrically conductive plug 180 which has a cylindrical outer surface exposed for electrical contact with the surrounding conductive fluid. The outer surfaces of both the sleeve 210 of stiffener 202 and the plug 180 are copper plated to enhance conductivity. The plug 180 is threaded into the lower end 182 of sleeve 172. A non-conductive sleeve 184 on plug 180 electrically isolates the plug 180 from the sleeve 172. The sleeve 172 is electrically insulated by insulators from the contact 174, rod 176 and plug 178 as generally indicated in FIG. 5. If needed, the sleeve 172 may either be made of a non-conductive material or of a conductive material, but with a non-conductive epoxy coating covering the outside, so as to electrically insulate the same from the conductive fluid.

Figure 10:
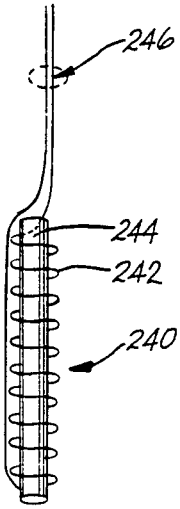
FIG. 10 is a schematic diagram of an alternate receiver which receives electromagnetic fields.

FIG. 10 depicts an alternate arrangement in which the receiver is of a solenoid-type which receives magnetic fields or signals produced by the transmitter. The receiver 240 is in the form of a coil spirally wound around a cylindrical ferrite core 244. The ends of the coil 242 are connected between the central conductor and the conducting metal sheath on a wire line 246 above, which extends to the top of the well. Preferably the receiver is housed in a non-magnetic housing (not shown) the diameter of the antenna is preferably approximately the same as or smaller than the diameter of the wire line 246.

Figure 11:
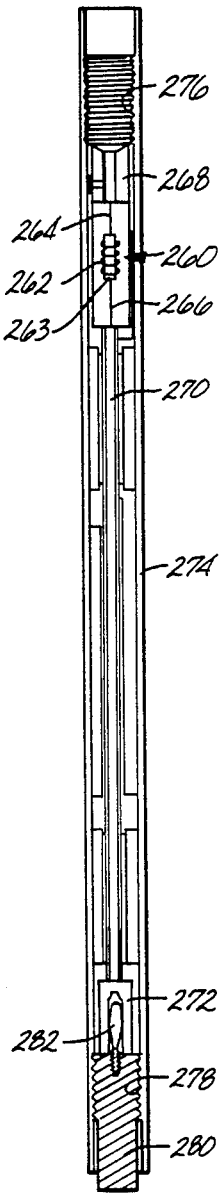
FIG. 11 is a schematic and cross-sectional view of a preferred receiver for receiving electromagnetic fields.

FIG. 11 depicts a preferred construction for the inductive type or solenoid type receiver for mounting at the down hole end of the stiffener such as stiffener 202 as depicted in FIG. 3. The receiver coil assembly is depicted at 260 and includes a coil 262, wound about a core 263. The coil has leads or ends 264 and 266 which are connected, respectfully, to an electrically conductive receptacle 268 and a contact rod 270. The receptacle 268 is constructed for receiving and electrically forming a connection with the plug 214 of stiffener 202. The opposite end of the rod 270 from the lead 266 is electrically connected to another receptacle 272. The assembly also includes an outer electrically conductive sleeve 274, having upper threaded end 276 into which threads on the lower end 218 of the stiffener 202 are inserted. The sleeve 274 also has a lower threaded end 278 into which a plug 280 is threaded. The plug 280 has a spring-type plug 282 which is inserted into and forms electrical contact with the receptacle 272. The plug 280 is an electrically conductive material which electrically connects the receptacle 272 and hence the rod 270 and lead 266 of the coil 262 to the outer electrically conductive sleeve 274, which in turn is electrically connected through the conductive outer sleeve of the stiffener 202 to the electrically conductive sub, and therefore to the electrically conductive outer sheath of the wire line 200. The other end 264 of the coil 262 is electrically connected through the receptacle 268 to the plug 210 and hence to the conductor 206 of the wire line. As a result the magnetic signals received by the coil, cause electrical signals to be applied between the ends 264 and 266 of the coil, which in turn may be sensed at the top of the well between the center conductor and outer sheath of the wire line.

Figure 12:
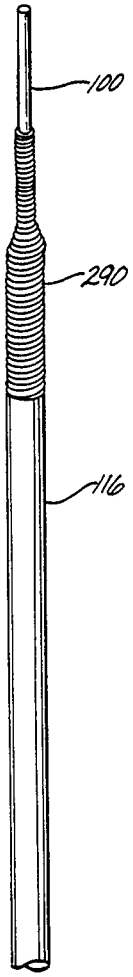
FIG. 12 is a schematic and side elevation view of the upper portion of a cable head, such as that depicted at the left in FIG. 3 including a spring tappered upper end for making the transition between the wire line and the cable head.

FIG. 12 depicts the upper end of the sleeve 116 of the cable head made-up to the wire line 100. A coiled conical shaped spring 290 is wound around the sleeve, the babbit-type stinger 114 (see FIG. 3) and along a short distance of the wire line 100. This structure is important in that it allows the flowing fracture fluid to pass from the transition between the wire line 100 and the cable head along a rather smooth gradual transition as opposed to an abrupt change which would be present without the conical spring.

Additionally, the conical spring 290 absorbs the side motion of the stiffener and protects the wire line as it bends preventing it from wearing and breaking at the up hole end of the babbit-type stinger.

Figure 13:
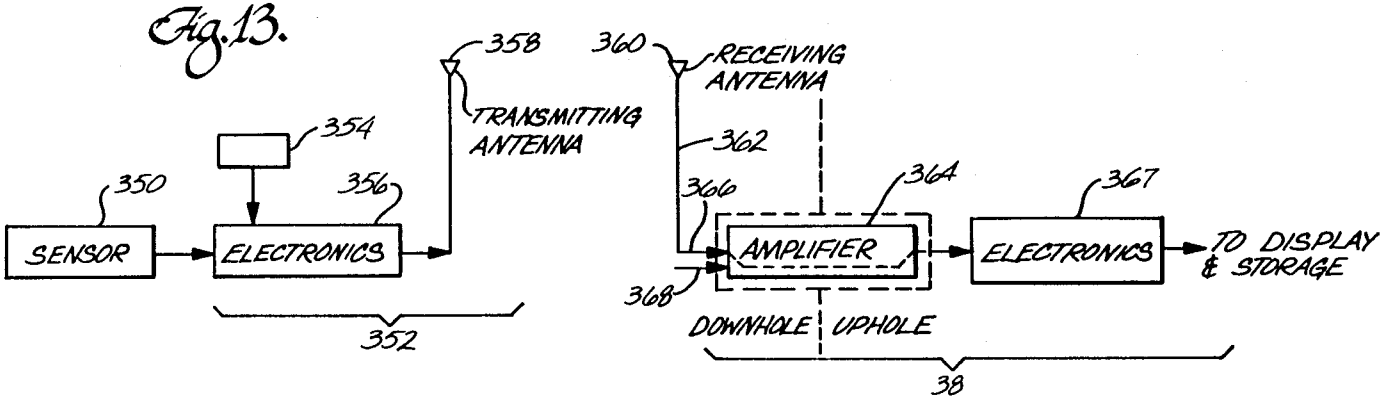
FIG. 13 is a schematic diagram of a sensor, transmitter, receiver and processing display and storage for use in the system of FIGS. 1 and 2.

Refer now to FIG. 13 which depicts a schematic diagram of over all systems involved in detecting, providing and sending data signals representing a parameter from down hole to the top of the well bore. Sensor 350 senses the parameter, preferably pressure, and provides a data signal to transmitter 352. The transmitter 352 includes electronics 356 and a signal sender for sending signals into the annulus between the tubing string and the casing. The signal sender is generally referred to herein for ease of reference as transmitting antenna 358 and includes either apparatus for inducing potentials in the conductive fluid in the annulus or the solenoid type antenna which generates electromagnetic fields into the annulus. Also included is a battery 354 for providing power to the electronics 356 and if necessary to the sensor 350. To be explained in more detail the electronics 356 may take on a number of configurations, however, it is arranged for receiving data signals from the sensor 350 representing the second parameter and for producing data signals which can be sent by the transmitting antenna 358 to and received by a receiver. The sensor 350, transmitter 352 and power supply 354 are always located down hole. A receiver, also referred to for convenience, as a receiving antenna 360, receives the data signals representative of the parameter which has been sent into the annulus by the transmitting antenna 358. In one embodiment a wire line 362 (with one or multiple conductors), conduct data signals representative of the parameter (represented by the received data signals) up hole to receiving electronics, display and storage apparatus 38 (see FIG. 1). Apparatus 38 includes amplifier 364 which amplifies the data signals from the wire line and receiving electronics 367, which processes the amplified signals into a form suitable for display and/or storage by means not shown in FIG. 13.

To be explained in the more detail the amplifier 364 may be divided up into two amplifier sections, a preamplifier section down hole at the lower end of the wire line near the receiving antenna 360 and an amplifier section up hole. The preamplifier section preamplifies the signals before they are conducted by the wire line up hole to the rest of the amplifier section. If the signal is preamplified before conduction up the wire line, the wire line must be a coaxial conductor, by way of example as shown in FIG. 3. Also, power can be provided over the wire line from the top of the wire line without adding additional conductors thus avoiding the need for batteries or other sources of power down at the receiver. It should also be noted that the amplifier will have two inputs indicated at 366 and 368. The input 366 may be connected to the insulated conductor in the wire line whereas the other input 368 may be connected to a shield (if present) or other conductor in or on the wire line, the upper end of the casing 24 at the top of the well or to one or more ground electrodes positioned in the ground around the well, depending on the configuration and design of the system. Where the receiving antenna receives potentials, the shield or other conductor of the wire line, the upper end of the casing or the ground electrodes connected to the second input 368 become a source of reference potentials or a reference with respect to which the signals at input 366 are detected. In the arrangement where the receiving antenna 360 is a magnetic pick-up, picking up magnetic signals, the inputs 366 and 368 will be effectively connected across the ends of the coil forming a part of the magnetic pick-up in the receiving antenna.

With the foregoing in mind it will be appreciated that if all sections of the amplifier 364 are contained at the top of the well, then the receiving antenna and everything at the bottom of the wire line will be passive and thus will minimize the amount of the electronics, the power required down hole and the outer size of the equipment lowered on the end of the wire line. If on the other hand portions of the amplifier or other electronics are located down hole at the lower end of the wire line, then the equipment at the receiving antenna is not passive and may require additional and larger equipment then with a passive arrangement.

Figure 14:
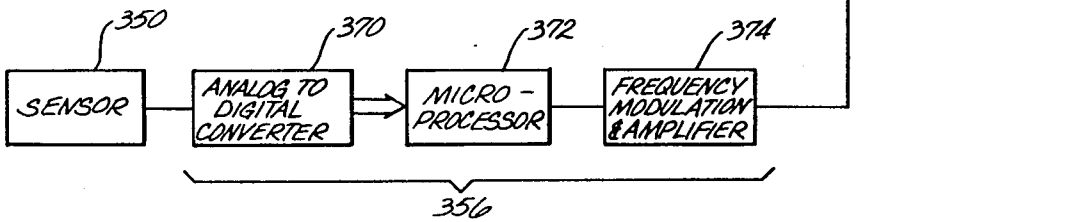
FIG. 14 is a schematic and block diagram depicting the sensor and details of a transmitter for forming digitally encoded frequency modulated carrier signals representing the parameter.

FIG. 14 shows a specific example of the electronics 356. Specifically the sensor provides an analog output whose amplifier is proportional to sensed pressure. Analog to digital converter 370 converts the analog signal to digital coded signals for a micro-processor 372. The micro-processor 372 converts the digital signals into a serial and redundantly encoded bit string. The frequency modulation and amplifier unit 374 then transmits the serial bit string via transmitting antenna 358 into the annulus using a signal of one frequency to represent a binary 0 and a signal of a second frequency to represent a binary 1. The data signal is then sent by the transmitting antenna 358 into the annulus.

It should be understood that the frequency modulator 374 may be replaced by other suitable means for forming signals that may be sent out into the annulus by antenna 358, such as circuits which produce amplitude modulated signals, phase modulated signals or other suitable signals for transmission by transmitting antenna 358.

The analog-to-digital converter 370 may comprise any one of a number of converters well known in the art as may processor 372. Preferably the processor is a CMOS circuit and encodes the signals provided to frequency modulator 374 to a form which allows error correction. Preferably the microprocessor 372 provides digital signals to the frequency modular 374 at the rate of 1 binary bit per second. A suitable carrier frequency is preferably as low as 10 to 20 hertz and as high as 10 kilohertz or higher.

Figure 15:
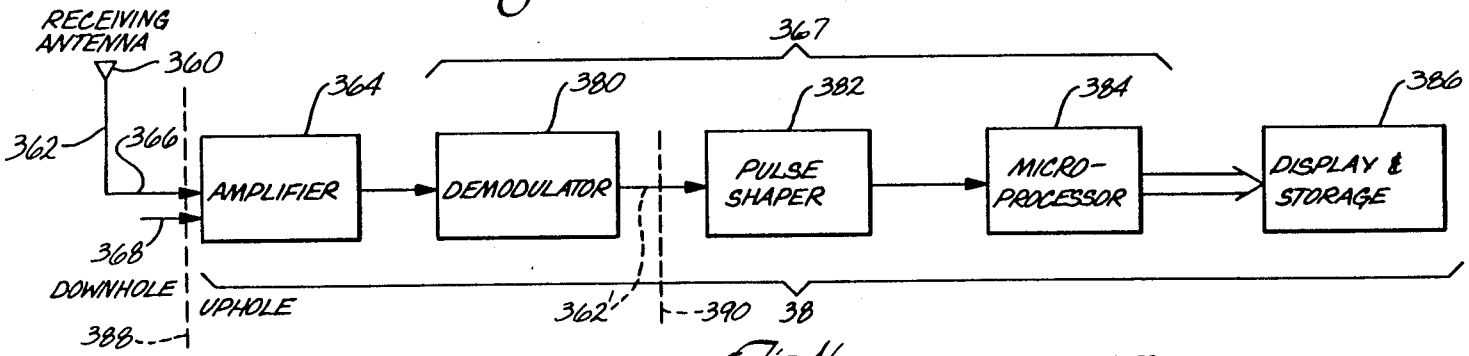
FIG. 15 provides a schematic and block diagram depicting the details of the processing display and storage for frequency modulated carrier signals received by the receiver of FIG. 13.

FIG. 15 depicts a specific embodiment of the receiving portion of FIG. 13 including the receiving antenna 360 and the receiving electronics, display and storage apparatus 38. Apparatus 38 includes amplifier 364, electronics 367, and a display and storage unit 386. The system of FIG. 15 is for receiving data signals represented by the frequency modulated signals produced by the system of FIG. 14. Specifically, receiving antenna 360 receives the frequency modulated data signals from the antenna 358 of FIG. 14. With a passive system the signals are conducted directly from the antenna 360 up the wire line 362 to amplifier 364 where the data signals are amplified. The demodulator 380 converts the amplified data signals from frequency modulated signals to digital signals representative of the parameter. Pulse-shaper 382 shapes the signals into a proper form for reading by micro-processor 384. Micro-processor 384 processes the digital signals into the proper form for display such as on a digital visual display and for storage such as on magnetic tape, disk or the like.

The system of FIG. 15 just discussed is passive, that is, none of the amplifier or other electronics, are located at the bottom of the wire line.

In another arrangement the amplifier 364 and demodulator 380 are located down hole at the receiving antenna as depicted to the left of dash line 390 and the pulse-shaper, microprocessor in display and storage are located up hole as indicated to the right of dash line 390. With this latter arrangement, wire line 362 would be replaced by a suitable electrical connector to amplifier 364 and the wire line would be positioned at 362' between the demodulator and the pulse-shaper. With this arrangement the signals will be of higher amplitude and therefore easier to detect at the top of the hole than if no amplifier is provided down hole.

Figure 16:
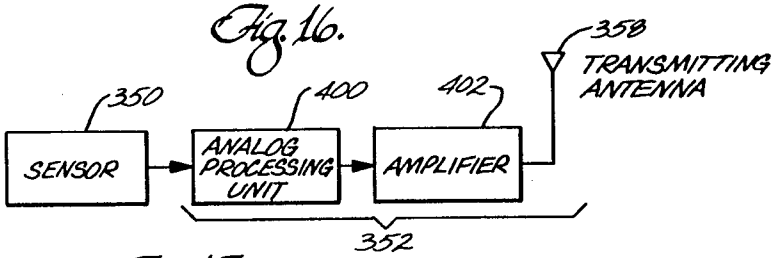
FIG. 16 is a schematic and block diagram depicting an alternate arrangement of the sensor and transmitter in which analog signals from the sensor are converted to frequency modulated signals for sending to the receiver.

FIG. 16 depicts a specific embodiment of the sensor electronics and transmitting antenna 358 shown to the left in FIG. 13 where the pressure parameter data signals are encoded in analog form. The analog output data signals from the sensor 350 representing the pressure parameter are processed by the analog processing unit 400 and converted to a frequency modulated signal, the frequency of which represents the analog signal and hence parameter. The frequency modulated signal is then amplified by amplifier 402 and then sent to the transmitting antenna 358 for sending data signals into the annulus for pick-up by the receiving antenna. The analog processing unit 400, by way of example operates on an analog signal from 0–5 volts and converts these signals to a frequency from 10–several thousand hertz, the actual frequency being proportional to the actual voltage level of the analog signal. Preferably the analog processing unit 400 alternates between the frequency representing the actual analog signal and a signal representing the full scale analog output for calibration purposes at the top of the well.

Figure 17:
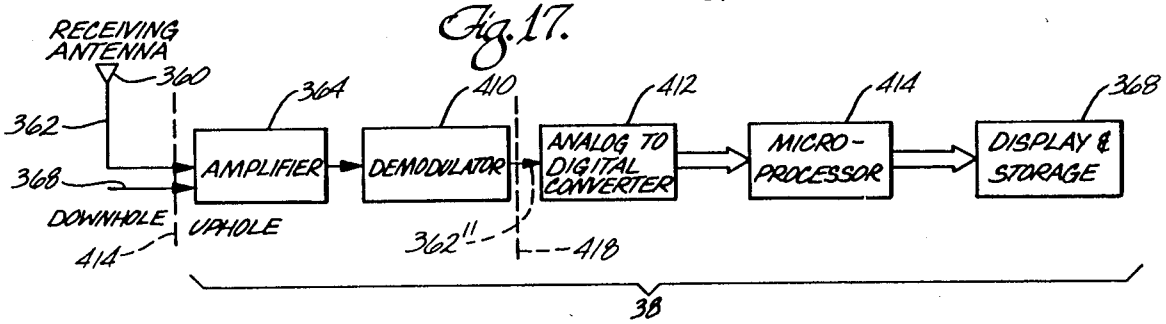
FIG. 17 depicts a receiver and processing, display and storage apparatus for use with the data signals provided by FIG. 16.

FIG. 17 depicts the receiving antenna 360 and the receiving electronics and display and storage apparatus 38 for use with the data signals formed by the transmitter of FIG. 16. Specifically, the data signals sent by antenna 358 of FIG. 16 are received by receiving antenna 360, signals corresponding thereto representing the sensed parameter are conducted up the wire line 362 to amplifier 364 which amplifies the signals and provides them to demodulator 410. Demodulator 410 converts the frequency modulated signals back to analog voltage signals in the range of between 0–5 volts, the magnitude of which represents the value of the parameter. Analog to digital convertor 412 converts the analog signals to digital form for the micro-processor 414. The micro-processor 414 does signal processing to remove errors from the signal and to convert the digital signals to a form which can be displayed and stored by display and storage unit 386 in the manner discussed above.

With the arrangement just discussed, the down hole portion of the system at the receiving antenna 360 is passive. To this end the dash line 418 indicates that everything to the left is down hole whereas everything to the right is up hole. It may be desirable in some applications to locate the amplifier and demodulator down hole at the receiving antenna 360, in which case the portion to the left of dash line 418 will be down hole and the portion to the right will be up hole and the wire line will be at 362" between the demodulator and the analog to digital convertor.

The digital system depicted in FIGS. 14 and 15 are potentially more accurate than the analog versions of FIGS. 16 and 17, since the digital version error correcting encoding methods can be used to correct for the effects of noise in the transmission link.

The analog version depicted in FIGS. 16 and 17 has an advantage in that less down hole electronics are generally required in order to conduct the signals to the top of the well, making it easier to design for high temperatures. Additionally, less power is required down hole.

Figure 18:
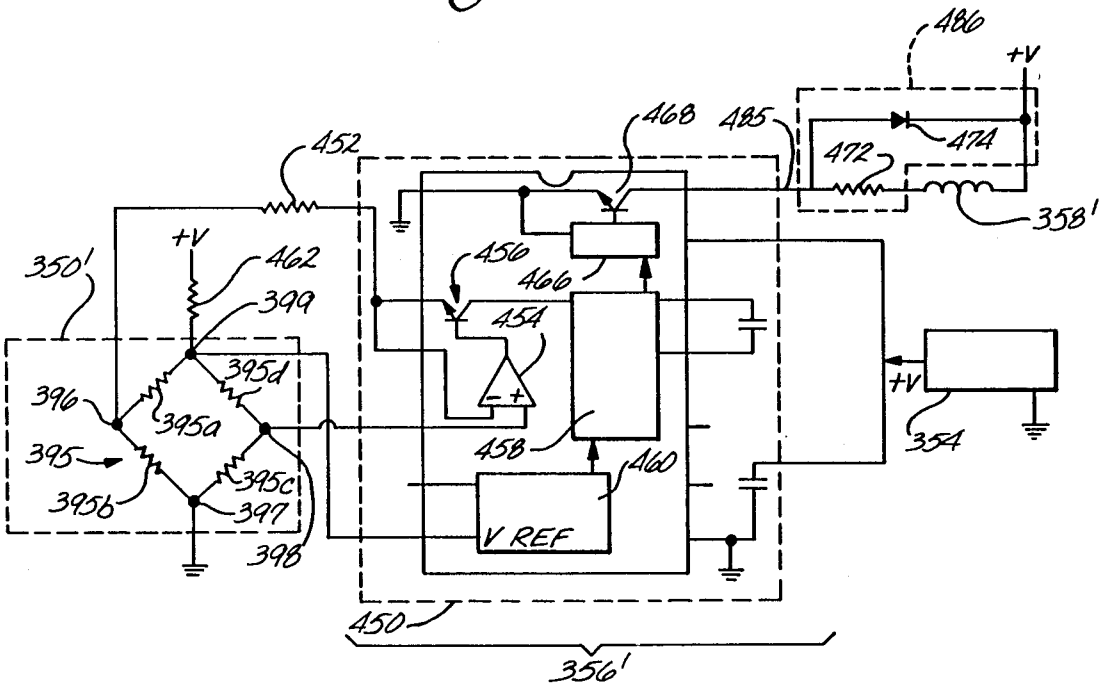
FIG. 18 is a detailed schematic diagram of the sensor and transmitter for forming electromagnetic fields for use in FIG. 13.

FIG. 18 depicts a specific example of the sensor, electronics and transmitting antenna of FIG. 13 which produces magnetic fields and electrical potentials in the annulus. Although the circuit of FIG. 18 forms electrical potentials in the conductive fluid for the electrode receiver, it is preferrably used to form magnetic signals for inductive type receivers where there is a close spacing between the transmitting antenna and the receiver.

Sensor 350' includes a balanced bridge circuit 395 having a conventional four terminal bridge with resistors 395*a*, 395*b*, 395*c*, and 395*d*, each connected between a different pair of terminals. Terminal 397 is connected to the ground conductor for power supply 354. Terminal 399 is connected through resistor 462 to the +V side of power supply 354. Variable pressure sensitive resistor 395*a* is connected between the terminals 396 and 399, the resistance of resistor 395*a* varies as a function of pressure sensed by the sensor.

Electronics 356' preferably includes an integrated circuit chip 450 of the type AD 537 manufactured by Analog Devices of Norwood, Mass., which converts the analog signals from the pressure sensor to a frequency modulated carrier signal for application to the receiving antenna 358'. The chip 450 includes a voltage to frequency convertor 458, operational amplifier 454, and the NPN transistor 456, a transistor driver 466, NPN transistor 468 and a source of reference voltage 460. The terminal 398 between resistors 395*c* and *d* of the bridge is coupled to the + input of amplifier 454. The terminal 396 between resistors 395*a* and *b* of the bridge is coupled through resistor 452 to the− input of amplifier 454. The output of amplifier 454 is connected to the base electrode of transistor 456. The emitter electrode of transistor 456 is coupled to the junction between resistor 452 and the− input of amplifier 454. The collector electrode of transistor 456 is connected to the control input of voltage to frequency convertor 458. Voltage to frequency convertor 458 provides a signal through driver circuit 466 to transistor 468 which signal has a frequency that is proportional to the current supplied through the collector of transistor 456. Power supply 354 applies an output of approximately +6 volts potential at the +V output. Resistor 462 is selected to cause a voltage of approximately +1 volts to occur at terminal 399 of the bridge. The internal reference generated at the output to convertor 458 by V reference 460 will be proportional to the signal at terminal 399. Preferably the resistor 462 is approximately 1750 OHMS with a pressure sensing resistor 395*a* value of approximately 450 OHMS. As a result a small amount of current is drawn from the voltage reference at terminal 399.

The output, at which the resultant frequency signals are formed by the convertor 458, is coupled through driver circuit 466 to the base electrode of transistor 468. The transistor 468 operates in a switching mode. The emitter electrode of transistor 468 is connected to ground, whereas collector electrode, of the transistor is connected by conductor 485 through a current limiting resistor 472 to one side of the coil in the transmitting antenna 358'. The opposite side of the coil of the transmitting antenna 358' is connected to the +V output of the power supply 354. As a result the frequency modulated signals formed by the converter 458 cause the transistor 468 to form signals in the coil of the transmitting antenna 358' causing it to form electromagnetic fields, which are picked up by the corresponding receiving antenna.

Diode 474 is connected in parallel with resistor 472 and the coil of transmitting antenna 358 and limits voltage at the collector of transistor 468 as well as provides a discharge path for current in coil of antenna 358' when transistor 468 is switched off. Resistor 472 is a current limiting resistor in both the charge and discharge cycles and also sets the resistance inductance time constant. The power supply 354 is preferably three high temperature lithium battery cells with unregulated voltage, but the voltage must be greater than 5 volts DC. With this arrangement the sensor electronics and transmitting antenna can be run directly from a battery type power supply 354 and the chip is relatively insensitive to supply voltage variations.

Figure 19:
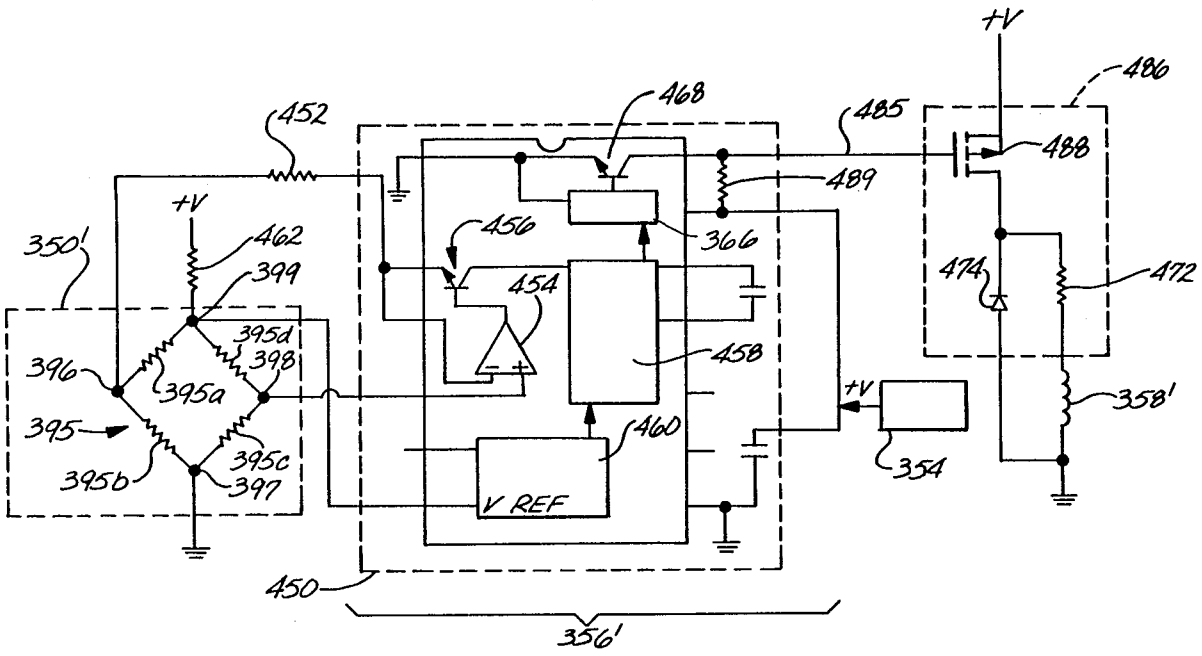
FIG. 19 is a schematic and block diagram similar to FIG. 18 modified to produce a stronger signal in the annulus.

The circuit of FIG. 19 is essentially the same as FIG. 18 except that it is modified to provide greater amplification to the signals being sent by the transmitting antenna and hence greater output power so that the signals can be transmitted over a larger separation between the transmitting antenna and the receiving antenna. In this regard a MOSFET transistor 488 or amplifier, is provided with its control electrode connected to output conductor 485 and its output electrodes connected between the +V output of battery 354 and the junction between diode 474 and resistor 472. The junction of diode 474 and the coil of the transmitting antenna 358' are connected to the ground conductor for the power supply 354. In addition, a pull up resistor 489 is connected between the control electrode of transistor 488 and the +V output of the battery 354.

Where there is a closely spaced relation between the transmitter and receiver, the transmitter may transmit and the receiver may receive optical signals or acoustic signals.

Although a wire line having one or more conductors for passing the data signals to the top of the well bore is the preferred form of the flexible line, it will be understood by those skilled in the art that a flexible line with fiber optic conductors may be used with appropriate means for conversion of the received data signals to optical form.

Also, if spacing between transmitter and receiver is sufficiently close, applications may be encountered where the optic or sonic wave signals may be transmitted by the transmitter and received by the receiver.

It should be noted that the above are preferred configurations, but others are foreseeable. The described embodiments of the invention are only considered to be preferred and illustrative of the inventive concepts. The scope of the invention is not to be restricted to such embodiments. Various and numerous other arrangements may be devised by one skilled in the art without departing from the spirit and scope of the invention.

What is claimed is:

1. A method for recovering data up hole at a top of a well bore while passing fracturing fluid down hole to a geological formation through a zone, having up hole and down hole extremities, in the well bore, comprising the steps of:

positioning a parameter sensor and a transmitter of data signals, which represent a parameter sensed by the sensor, at a location in the well bore at a position which is substantially down hole from the zone down hole extremity;

lowering in the well bore a flexible line, while suspending from the line, a receiver, which is separate from the sensor and transmitter, and a stiffener extending up hole from the down hole extremity of the receiver, and including the step of lowering the line until the receiver is in signal receiving proximity to the transmitter and the stiffener extends substantially from the zone up hole extremity to the zone down hole extremity in front of the zone;

transmitting with the positioned transmitter and receiving with the positioned receiver, data signals which represent a parameter sensed by the sensor; and passing data signals representing the parameter represented by the received data signals up to the top of the well bore through the stiffener and over the flexible line.

2. The method of claim 1 wherein the step of passing data signals comprises the step of conducting the data signals up the flexible line.

3. The method of claim 1 wherein the step of lowering comprises its step of:

lowering at least one substantially rigid cylindrical member as said stiffener.

4. The method of claim 3 wherein the step of lowering said at least one substantially rigid cylindrical member comprises the step of lowering a plurality of said at least one cylindrical members attached end to end as said stiffener.

5. The method of claim 1 wherein the step of lowering comprises the step of lowering the receiver attached to a free lower end of said at least one cylindrical member.

6. The member of claim 1 wherein the step of positioning the sensor and transmitter comprises the step of:

releasing the sensor and transmitter in the well bore allowing them to fall down the well bore.

7. The method of claim 6 wherein the step of releasing the sensor and transmitter comprises the step of releasing the sensor and transmitter together in a common module.

8. The method of claim 6 further comprising the step of at least partially forcing the module down the well bore with fluid.

9. The method of claim 1 wherein the receiver comprises at least one electrode exposed in the well bore, and wherein the step of lowering comprises the step of exposing the at least one electrode in the well bore to the fracturing fluid, and the step of transmitting and receiving comprises the step of creating and receiving potentials on the at least one electrode in the fracturing fluid.

10. The method of claim 9 wherein the step of lowering comprises the step of lowering such flexible line with at least one insulated conductor therein coupled to said at least one electrode for passing the data signals to the top of the well bore.

11. The method of claim 1 wherein the step of obtaining data at the top of the well bore comprises the step of sensing, at the top of the well bore, a potential on the line relative to a reference potential.

12. The method of claim 1 wherein the step of lowering comprises the step of lowering a flexible line comprising at least one insulating conductor and a further conductor and a receiver comprising first and second exposed electrodes electrically coupled, respectively, to the at least one insulated conductor and the further conductor.

13. The method of claim 1 wherein the step of lowering comprises the step of lowering a receiver comprising means for magnetically sensing electromagnetic fields in the well bore.

14. The method of claim 1 wherein the data signals are transmitted by the transmitter and received by the receiver while fracturing fluid is passed by said stiffener through the zone into the formation.

15. In combination with a well bore having a zone through which fracturing fluid is passed to a geological formation, means for recovering data up hole at a top of the well bore, the means comprising:

a parameter sensor and a transmitter of data signals, which represent a parameter sensed by the sensor, at a location in the well bore which is substantially down hole from the zone's down hole extremity; and a flexible line, having suspended therefrom a receiver, which is separate from the sensor and transmitter, and a stiffener extending up hole from the down hole extremity of the receiver, the stiffener extending substantially from the zone's up hole extremity to the zone's down hole extremity in front of the zone;

the transmitter being adapted for transmitting and the receiver being adapted for receiving data signals which represent a parameter sensed by the sensor; and the line passing data signals representing the parameter represented by the received data signals up to the top of the well bore.

16. Means for receiving data signals from a sensor and transmitter and for passing data up hole to the top of a well bore while passing fracturing fluid down hole to a geological formation through a zone in the well bore, comprising:

a flexible line, having suspended therefrom a receiver adapted for receiving data signals from the sensor and transmitter while separated in location from the sensor and transmitter, and a stiffener positioned up the well bore from a lower extremity of the receiver, the line being adapted for passing data signals representing a parameter represented by the received data signals up to the top of the well bore.

17. Means as defined in claims 15 or 16 wherein the flexible line comprises a wire line.

18. Means as defined in claim 17 wherein the flexible line comprises at least one insulated conductor for conducting the data signals to the top of the well bore.

19. Means as according to claim 15 or 16 wherein the stiffener is more rigid compared with the flexible line.

20. Means according to claim 15 or 16 wherein the stiffener comprises at least one tubular member.

21. Means according to claim 15 or 16 wherein the receiver receives electrical potentials from fluid in contact with the receiver.

22. Means according to claim 21 wherein the receiver comprises an exposed electrically conductive electrode.

23. Means as defined in claim 15 or 16 wherein the receiver comprises means for receiving electromagnetic fields.

24. Means according to claim 23 wherein the receiver comprises a coil.

25. Means according to claim 15 or 16 wherein the transmitter comprises a coil.

26. Means according to claim 15 or 16 wherein the transmitter comprises a coil about a conductive member.

27. Means according to claim 15 or 16 wherein the stiffener comprises at least one cylindrical shaped member.

* * * * *

UNITED STATES PATENT AND TRADEMARK OFFICE

CERTIFICATE OF CORRECTION

PATENT NO. : 4,828,051

DATED : May 9, 1989

INVENTOR(S) : P.F. Tichener; M. J.M. Walsh

It is certified that error appears in the above-identified patent and that said Letters Patent is hereby corrected as shown below:

On the Front Page:

Abstract, line 5, change "thereform" to -- therefrom --.

In the Specification:

Column 1, line 15, after "or" insert -- Gas Well Bore --.

Column 2, line 53, after "to" insert -- the --.

Column 3, line 61, change "tappered" to -- tapered --.

Column 4, line 30, after "46" delete -- into --.

Column 8, line 62, change "respectfully" to -- respectively--

Column 10, line 2, change "respectfully" to -- respectively--
Column 10, line 45, change "over all" to -- overall --.
Column 10, line 62, change "second" to -- sensed --.

Column 11, line 11, before "more" delete -- the --.
Column 11, line 55, change "then" to -- than --.
Column 11, line 58, change "amplifier" to -- amplitude --.

UNITED STATES PATENT AND TRADEMARK OFFICE

CERTIFICATE OF CORRECTION

PATENT NO. : 4,828,051

DATED : May 9, 1989

INVENTOR(S) : P.F. Tichener; M. J.M. Walsh

It is certified that error appears in the above-identified patent and that said Letters Patent is hereby corrected as shown below:

In the Claims:

Column 18, line 1, before "according" delete -- as --.

Signed and Sealed this

Twenty-seventh Day of February, 1990

*Attest:*

JEFFREY M. SAMUELS

*Attesting Officer* *Acting Commissioner of Patents and Trademarks*